United States Patent [19]

Clark

[11] Patent Number: 4,766,633

[45] Date of Patent: Aug. 30, 1988

[54] TOOTH AND SULCUS BRUSH

[76] Inventor: Quentin S. Clark, 1935 Wilbur Ave., San Diego, Calif. 92109

[21] Appl. No.: 50,959

[22] Filed: May 18, 1987

[51] Int. Cl.[4] ..... A46B 9/04

[52] U.S. Cl. ..... 15/167.1; 15/143 R; 15/DIG. 5; 15/110

[58] Field of Search ..... 15/167.1, 167.2, 110, 15/143 R, DIG. 5; D4/104

[56] References Cited

U.S. PATENT DOCUMENTS

| | | | |
|---|---|---|---|
| 1,482,027 | 1/1924 | Ochse | 15/167 R |
| 3,152,349 | 10/1964 | Brennesholtz | 15/167 R |
| 4,033,008 | 7/1977 | Warren et al. | 15/167 R |

FOREIGN PATENT DOCUMENTS

| | | | |
|---|---|---|---|
| 201232 | 11/1986 | European Pat. Off. | 15/167 R |
| 291657 | 6/1928 | United Kingdom | 15/167 R |

*Primary Examiner*—Peter Feldman

[57] ABSTRACT

A toothbrush comprising five or seven rows of tufts of soft filaments or bristles of which the middle row of bristles is higher than the rows of tufts of bristles on each side. The middle row performs the special task of cleaning the gum line or sulcus while the rows on each side alternately, as used in various positions in the mouth, either clean the teeth themselves or support and massage the gum tissue.

1 Claim, 1 Drawing Sheet

SECTION A-A

FULL SIZE

TOOTH AND SULCUS BRUSH

This invention relates to an improved brush for cleaning the teeth and cleaning the gum line or sulcus and for massaging the gums.

The gum-line crevice or sulcus has long been recognized as one of the principal areas for the source of dental caries. Food can accumulate in this crevice and, if left there for any length of time, it can promote bacterial growth which is conducive to causing dental decay. The flat faced toothbrushes available on the market today are quite inefficient at cleaning this area. There are also concave face toothbrushes available which may be more efficient at cleaning this area but, if improperly used, can force the gums to recede.

Accordingly, this invention provides a toothbrush which has one row of higher bristles down the longitudinal center of the brush head and at least two rows of supporting bristles longitudinally alongside the center row but which are of a slightly lower height.

Both the center row, which is about 0.050 to 0.075 inches higher than the adjacent rows, and the outer rows are to be made of a soft nylon, or similar, filament about 0.005 to 0.0075 inches in diameter with their ends rounded, or both rounded and tapered by polishing so that the delicate gum tissue is not harmed by the brushing action.

The brush, when it is used to clean the teeth on each side of the mouth, is to be used in a slightly circular, boring in type of motion; moving from the gum line to the top of the teeth as is now recommended by many dentists for using a conventional toothbrush. A back and forth motion, that is longitudinal for the toothbrush, is not to be used. The higher center row of bristles will tend to sweep out the sulcus area while the lower bristles in the rows on one side support the gum tissue, helping to prevent receding of the gums, while the lower bristles in the rows on the other side, brush the teeth themselves. Also, when the brush is used in a somewhat vertical position, to clean behind the upper and lower front teeth, the higher row of bristles in the longitudinal center of the brush will work very well to clean any possible grooves in the back of the teeth and also efficiently clean the spaces between the teeth.

Another unique feature of the brush is the type of handle it embodies which will also facilitate its function.

An embodiment of the invention will now be described to explain the various components in detail:

Figure 6:
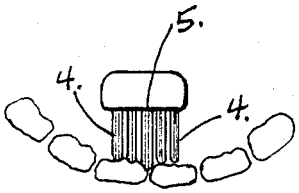
FIG. 6 represents a view of the brush held in a vertical position being used to clean the back of either the upper or lower teeth.
Figure 4:
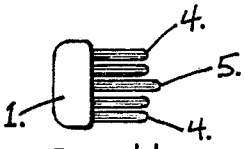
FIG. 4 is an end view of the toothbrush head.
Figure 2:
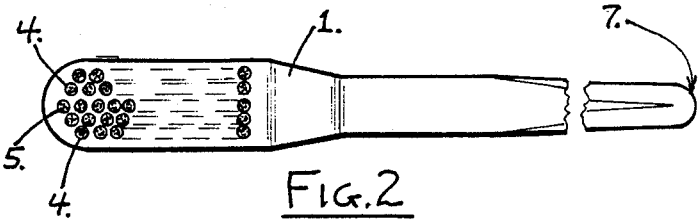
FIG. 2 is a plan view of the head of the toothbrush and shows the arrangement of the rows of bristles.
Figure 7:
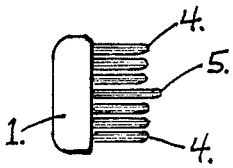
FIG. 7 is also an end view of the toothbrush head but as it would appear if three rows of bristles were used on each side of the center row.
Figure 3:
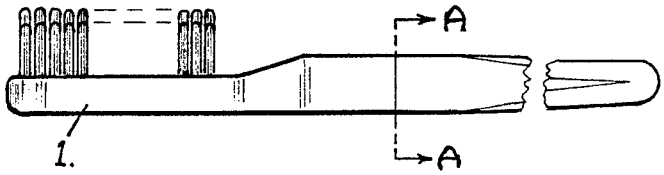
FIG. 3 is a side elevation of the toothbrush head.

This improved toothbrush consists of a handle (1) with a wider head portion to provide a unitary base for the tufts of brustles (4) and (5). The bristles are assembled in tufts placed in holes drilled or molded in the head portion. The individual tufts and rows of tufts are placed as closely together as is practical to provide a dense brushing surface. The center row of tufts (5) in FIGS. 3, 4, and 7 is made about 0.050 to 0.075 inches longer than the rows of tufts (4) on each side. As shown in FIGS. 3, 4, and 7, the tufts of shorter bristles (4) on each side of the center rows of tufts are all the same length and the longer center row of tufts (5) are all the same length. It is the special cleaning action of this center row of tufts as exemplified in FIGS. 5 and 6 that provides this toothbrush's unique cleaning action.

Figure 5:
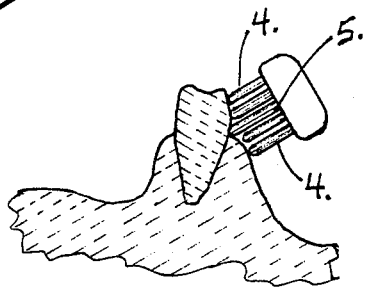
FIG. 5 represents a cross-section at the side of the user's mouth and shows the brush in one of its main brushing positions.

In FIG. 5 the longer row of tufts (5) is shown reaching into the cleaning the gum crevice or sulcus at the base of the teeth. Two of the shorter side rows (4) in this figure are supporting and massaging the gum tissue. While this cleaning is taking place, the other two rows (4) are cleaning the sides of the teeth. In use, the brush is not moved back and forth in motions parallel to the length of the handle but is used in a slightly circular boring in motion to clean the sulcus without damaging the base of the teeth. This same action occurs on both sides of the mouth and for upper and lower teeth except that the rows (4) alternately either support the gums or brush the teeth. When the brush is used to clean behind the upper and lower front teeth it is held with its handle parallel to the length of the body and and a longitudinal up and down motion is used with the center row (5) aiding the side rows (4) to clean the grooves and spaces between the teeth as shown in FIG. 6.

Figure 8:
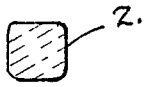
FIG. 8 is a cross-section of the handle—a short distance from the brush head.
Figure 1:
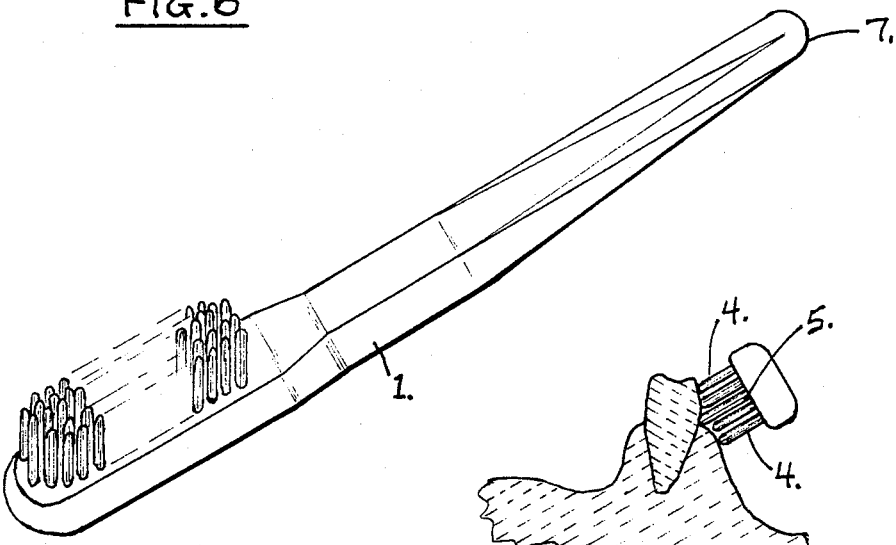
FIG. 1 is a full size perspective drawing of the toothbrush assembly.

Experience has shown me that there are four main positions in which a toothbrush is held while cleaning the teeth. To facilitate this and to make it convenient for any other position used, I have designed the handle with the handle being made up of a square shape for gripping a short distance away from the brush head as shown in FIG. 8. This square shape (2) then blends into a round cross-section as it progresses down the handle ending in a hemispherical end (7) on which to support and rotate the toothbrush as it is held in one's hand.

What is claimed is:

1. A toothbrush having a longitudinally aligned handle and a wider head portion on one end thereof for providing a unitary base for supporting bristles thereon, said unitary brush supporting base comprising a central single row of tufts of bristles and at least two parallel outer rows of tufts of shorter bristles on each side of said single row of bristles, said tufts of bristles on each side of said central row being all equal in length and said central row of longer tufts of bristles being all equal in length, said central bristles and said outer bristles having a diameter of about 0.005 to 0.0075 inches with their ends being rounded, said central single row of bristles exending from about 0.050 to 0.075 inches longer than the bristles on each side thereof, whereby when the toothbrush is used in a somewhat horizontal position, the longer bristles in the central row of tufts clean the sulcus area while the bristles on one side of said central row of bristles will serve to support and massage the gum tissue while the bristles on the other side of said central row of bristles will serve to clean the sides of the teeth and when the toothbrush is used in a somewhat vertical position to clean behind the upper and lower front teeth, the longer central row of bristles will serve to clean the spaces between the teeth, said handle having a square cross-section portion near said bristle supporting base for providing a finger-gripping area a short distance away from said bristle supporting base, said square cross-section portion then tapering into a round cross-section portion as it progresses down the handle, ending in a hemispherical end on which to support and rotate the toothbrush as it is held in one's hand.

* * * * *